United States Patent [19]

Thompson

[11] Patent Number: 4,462,697

[45] Date of Patent: Jul. 31, 1984

[54] INTEGRAL PLASTIC STRAP AND BEZEL FOR A WRISTWATCH

[75] Inventor: Harwell B. Thompson, Cheshire, Conn.

[73] Assignee: Timex Corporation, Waterbury, Conn.

[21] Appl. No.: 354,827

[22] Filed: Mar. 4, 1982

[51] Int. Cl.[3] ..... G04B 37/00

[52] U.S. Cl. ..... 368/282; 368/294

[58] Field of Search ..... 368/276, 281–282, 368/294–296, 301–302, 309

[56] References Cited

U.S. PATENT DOCUMENTS

| | | | |
|---|---|---|---|
| 2,792,684 | 5/1957 | Dinstman | 368/294 |
| 4,023,347 | 5/1977 | Haber | 368/282 |
| 4,326,281 | 4/1982 | Tanaka et al. | 368/294 |
| 4,403,870 | 9/1983 | Thompson et al. | 368/294 |

FOREIGN PATENT DOCUMENTS

| | | | |
|---|---|---|---|
| 1545812 | 11/1968 | France | 368/296 |
| 83899 | 2/1920 | Switzerland | 368/296 |
| 327028 | 2/1958 | Switzerland | 368/296 |
| 336017 | 3/1959 | Switzerland | 368/294 |
| 1189909 | 4/1970 | United Kingdom | 368/282 |

*Primary Examiner*—Vit W. Miska

*Attorney, Agent, or Firm*—William C. Crutcher

[57] ABSTRACT

A plastic strap and bezel are molded from plastic material to provide a bezel section and integrated flexible strap sections. The bazel is adapted to retain a bell-shaped crystal of transparent plastic with a central viewing portion. The crystal has a depending wall portion arranged to receive a caseback of metal or plastic with a water-resistant seal. The crystal wall portion includes an integral pendant for the stem or push button, and has ears or lugs, which are molded into the bezel or, which snap into bezel recesses.

7 Claims, 11 Drawing Figures

INTEGRAL PLASTIC STRAP AND BEZEL FOR A WRISTWATCH

This invention relates generally to an improved strap and case construction for timepieces, and more particularly to an integral plastic strap and bezel construction for a wristwatch of the type having a bell-shaped crystal and caseback forming a housing for the movement or module.

A conventional wristwatch construction generally includes a case, a crystal for viewing the hands or timepiece display, and a caseback, these three members together forming an enclosure which may or may not be water-resistant. The conventional means for attaching a strap or band is by means of spring bars, which snap into opposed lugs formed as a portion of the case.

Constructions have been proposed to reduce the number of parts and the cost of the wristwatch by eliminating the conventional spring bar attachment between the case and the strap and by incorporating the strap into portions of the watch case or bezel. Some proposals have used a one-piece strap with an enlarged area at the center with a hole in it to receive part of the watch case through the hole and with means to attach bezel and caseback members on either side of the strap. Such constructions are illustrated in U.S. Pat. No. 3,492,809 issued to A. Gisiger-Lusa on Feb. 3, 1970, and U.S. Pat. No. 4,267,850 issued to M. Schneider on Sept. 18, 1979. Proposals have also been made for providing a one-piece strap and case. In this construction, the strap is thickened and forms an enclosure to serve as part of the case. A caseback is attached to the thickened strap portion. In this manner a conventional module or movement may be placed inside the enclosure and viewed through an opening in the top of the strap. This type of construction is illustrated in U.S. Pat. No. 3,971,206 issued July 27, 1976, to Martino and U.S. Pat. No. 4,178,751 issued Dec. 18, 1979, to Liautaud.

Constructions are known for watch cases which, rather than having a conventional disk-shaped crystal attached at its edge to the bezel, use a bell-shaped crystal formed from a transparent plastic molding to include a depending cylindrical wall portion. The wall may include an integral pendant to receive the stem for a crown or push button. The caseback, in such cases, may be attached by a snap-fit onto the bottom of the depending wall portion. This construction of a so-called bell-shaped crystal is illustrated in U.S. Pat. No. 2,719,403 dated Oct. 5, 1955, and in U.S. Pat. No. 2,735,259 dated Feb. 21, 1956, both in the name of A. Gisiger.

Strap constructions are known, where the watch strap is molded of plastic so as to incorporate spaced indentations providing thin sections to act as hinges and impart additional flexibility to the plastic material. It is generally desired to have a watch strap of maximum flexibility for comfort, but to have a rigid bezel and watch case so as to protect the watch movement or module against damage. These two conflicting requirements have usually been satisfied in the past by means of a hard case with a flexible strap separately attached to it.

Accordingly, one object of the present invention is to provide an improved plastic strap and bezel for a wristwatch with a flexible strap section and a rigid bezel section.

Another object of the invention is to provide an improved case assembly for a wristwatch, having an integral plastic bezel and strap.

DRAWINGS

The invention, both as to organization and method of practice, together with further objects and advantages thereof, will best be understood by reference to the following specifications, taken in connection with the accompanying drawings, in which:

FIG. 1 is enlarged cross-sectional elevation view of a wristwatch case assembly showing the preferred form of the invention, FIG. 2 is a plan view of portions of the case assembly of FIG. 1, FIG. 3 is a plan view of the crystal molding in the preferred embodiment, FIG. 4 is a cross-sectional view of the crystal taken along IV—IV of FIG. 3, FIG. 5 is an elevation view, partly in section, of the full integral bezel and strap molding, with crystal incorporated, FIGS. 6 and 7 are plan view and cross-sectional elevation view, respectively, of the integral strap and bezel, according to a modified form of the invention, FIG. 8 and FIG. 9 are plan view and elevation view, partly in cross-section, of the bell-shaped crystal used in the modified form of the present invention, and FIG. 10 and FIG. 11 are enlarged cross-sectional elevation views along sections taken through the watch crown and taken through the strap section, respectively, showing the modified form of assembled wristwatch.

SUMMARY OF THE INVENTION

Briefly stated, the invention comprises the improvement in a wristwatch of the type having a bell-shaped crystal molded of transparent material with a central viewing portion and a depending wall portion with an integral pendant formed therein, and having a caseback adapted to be attached to said depending wall portion to form a water-resistant enclosure for the wristwatch, the improvement comprising an integral strap and bezel molded of plastic materials with the bezel interposed between and joined to opposite strap portions, the bezel having a central opening surrounding the central viewing portion of the crystal, and means including a plurality of protrusions on the crystal wall adapted to retain the crystal in the bezel.

DESCRIPTION OF THE PREFERRED EMBODIMENT

Figure 1:
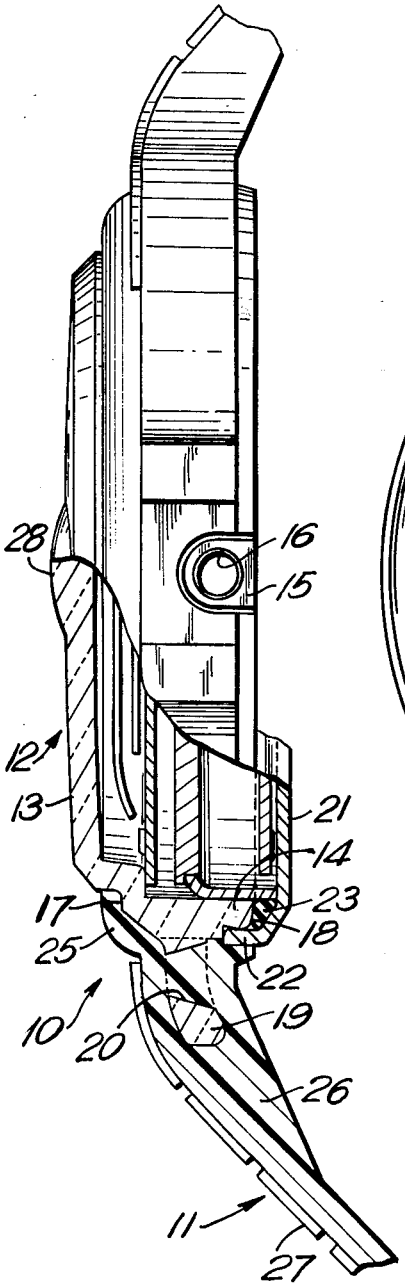
Figure 2:
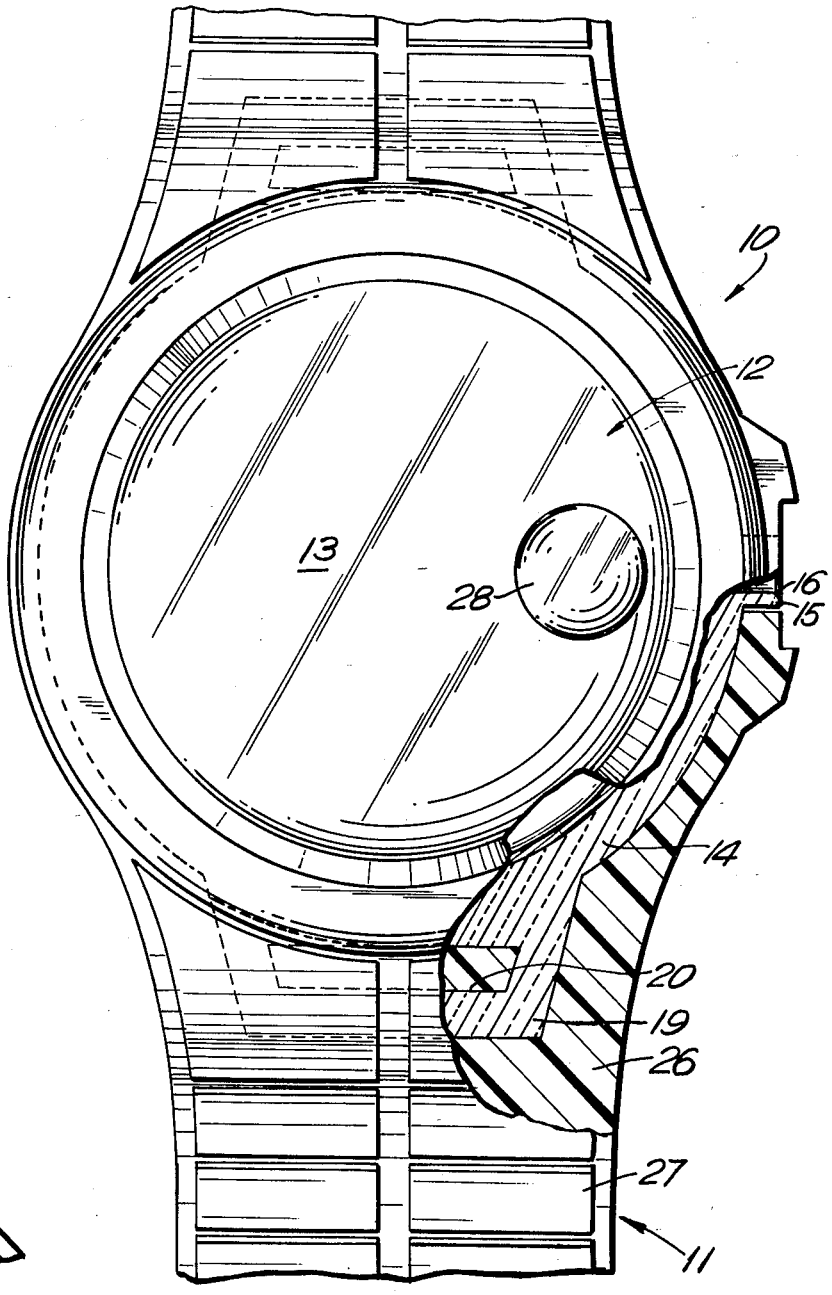

Referring now to FIG. 1 of the drawing, the integral strap and bezel comprises a bezel 10 gradually blending into a strap portion 11. Disposed inside the bezel enclosure is a bell-shaped crystal 12 molded of transparent plastic material, such as (Plexiglas V100, or similar material) to include a central viewing portion 13 and a cylindrical depending wall portion 14. Plexiglas is a registered trademark of Rohn & Haas Company, Philadelphia, PA. The depending wall incorporates an integral pendant 15 with a circular opening 16 to accomodate a conventional watch stem or push button. The crystal wall also includes a peripheral ledge 17 and terminates at its lower end in a peripheral rim 18. Extending from diametrically opposite sides of the crystal are protrusions, such as ears 19 with internal slots 20. Ears 19 are curved downwardly away from the viewing portion of the crystal and also tapered, as can be more clearly seen in FIG. 2 of the drawing.

A caseback 21 with a peripheral wall 22 is arranged to snap around the lower end of the depending wall portion 14 of the crystal. A compressible or elastomeric gasket 23 serves to provide a water-resistant enclosure when caseback 21 is snapped onto the depending wall portion 14 of the crystal. A conventional mechanical timepiece movement 135, which may alternately be a electronic module for a solid state or digital watch of a type well known in the art, is housed within the water-resistant enclosure.

In accordance with the present invention, the integral bezel and strap is molded from plastic material. Suitable plastic material is Thermoplastic Urethane, manufactured by K. J. Quinn and Co., Inc. The material preferably has a durometer on the order of Shore A 80A±3. Bezel portion 10 is molded with a ledge 25 overlapping the peripheral shoulder 17, a thickened downwardly slopping portion 26 surrounding the protrusions 19, and blending into the strap portion 11. The strap portions may have molded decorative raised sections 27 simulating conventional links.

During the molding process, the plastic material used for the bezel is extruded into the opening 20 of protrusions 19, serving as a secure means for retaining the crystal in the bezel enclosure. Other types of interlocking shapes on the protrusions, such as saw-teeth or bulbous protuberances may also be employed.

Figure 3:
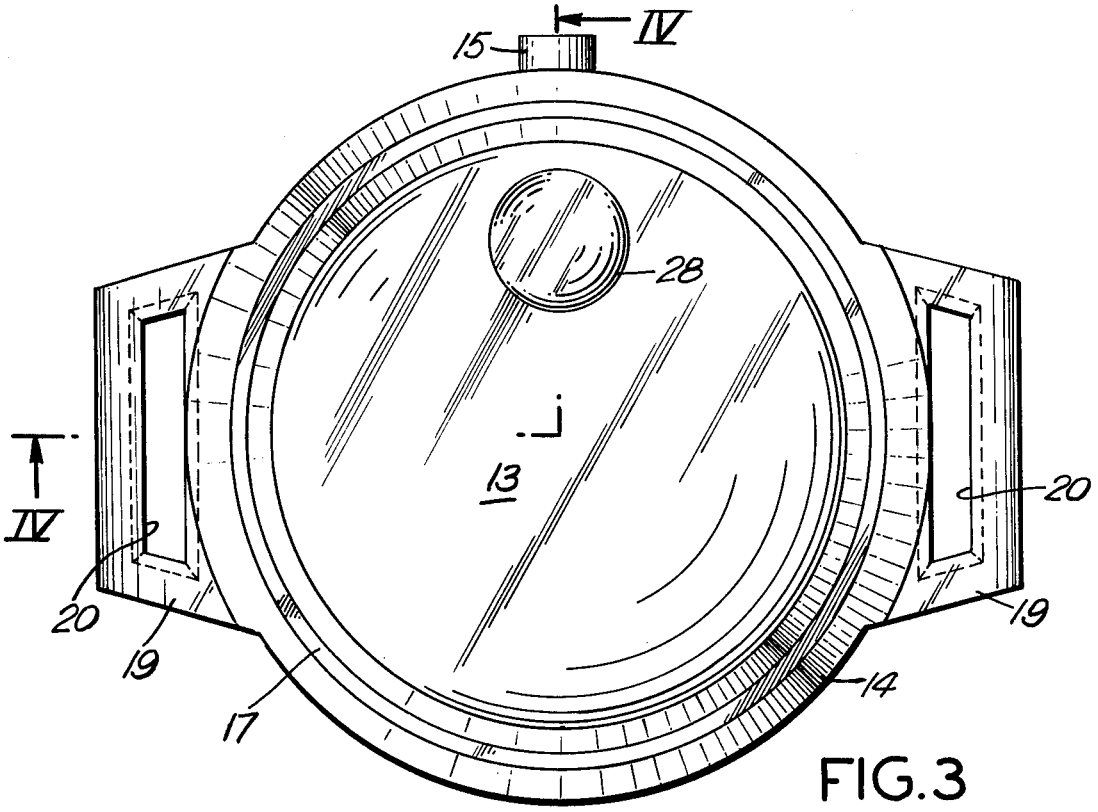
Figure 4:
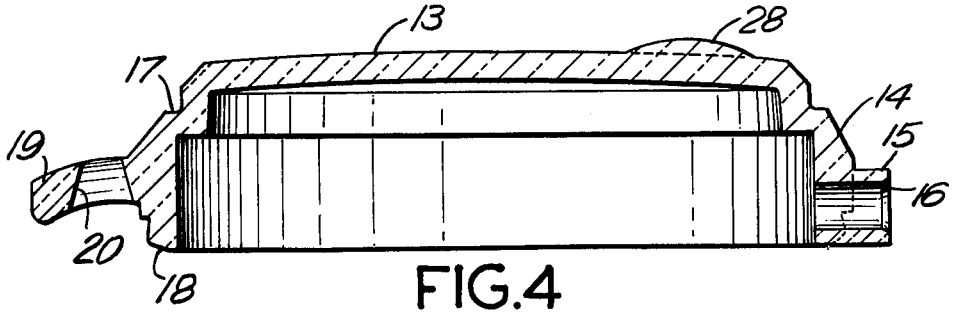

The details of the bell-shaped crystal molding may be seen more clearly by reference to FIGS. 3 and 4 of the drawing. It will be apparent that the molding of transparent plastic material serves multiple functions of: providing a viewing lens for the timepiece, providing an integral pendant, serving as a portion of the water-resistant enclosure (when attached to the caseback), and most importantly, providing the protrusions which cooperate with the integral bezel and strap. The crystal molding can incorporate a magnifying lens or "bubble" 28 to assist in viewing some particular portion of the time keeping dial, such as a day/date window.

Figure 5:
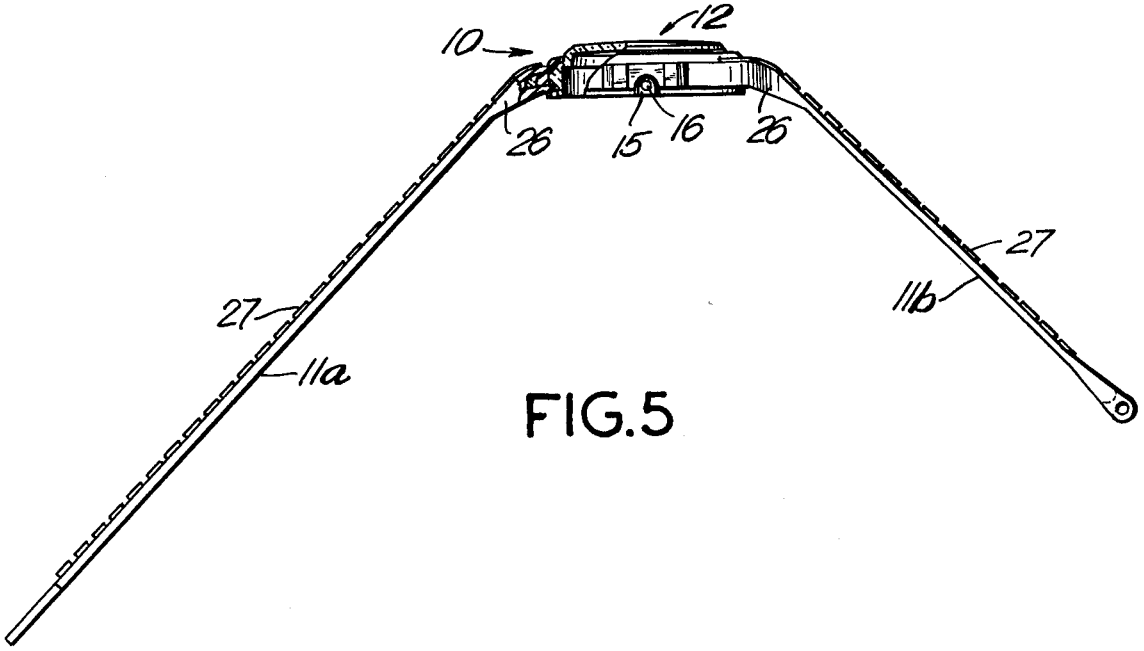

Referring to FIG. 5 of the drawing, the complete case and strap assembly is shown to include the bell-shaped crystal 12 and the integral bezel and strap assembled thereto. The bezel 10 is interposed between and joined to strap portions 11*a*, 11*b* for the tongue and buckle respectively. Since the thickened portions 26 on opposite sides of the bezel slope downwardly on either side away from the crystal viewing portion, and since the strap portions 11*a*, 11*b* are relatively thin, a comfortable curvature for the wrist is provided by the thickened portions while still maintaining rigidity of the case.

OPERATION

The process of assembling the time piece of FIGS. 1–5 is as follows:

The bell-shaped crystal is first molded of transparent plastic material. In a second molding operation, the integral strap and bezel material is injected into a second mold, which incorporates the previously molded crystal, so that the strap and bezel plastic material is overmolded and extruded into the slots 20 in protrusions 19. Next, the movement is inserted and caseback and gasket applied to enclosure the movement.

MODIFICATION

Figure 6:
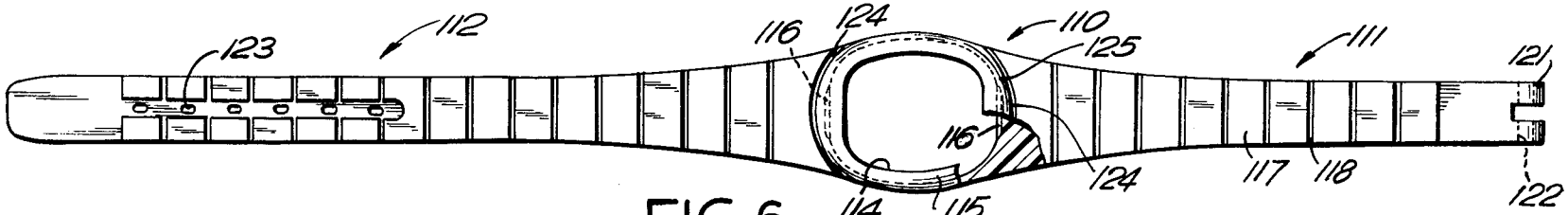
Figure 7:
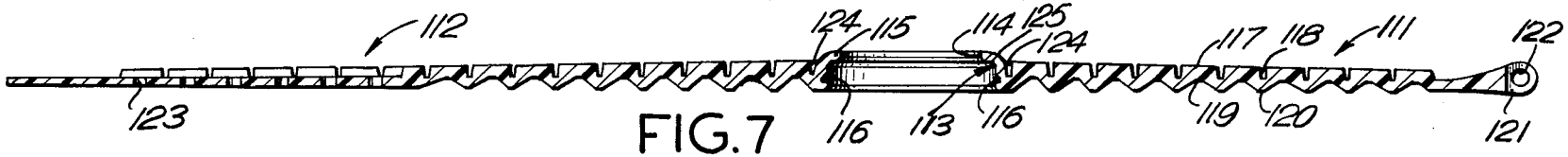

Referring now to FIGS. 6 and 7 of the drawing, the modified form of the integral strap and bezel comprises a bezel 110 interposed between and blending into strap portions comprising a buckle portion 111 and a tongue portion 112. In the embodiment shown in FIGS. 6 and 7, the bezel 110 and buckle and tongue portions 111, 112 are all molded at the same time of the same plastic material of medium durometer. Suitable plastic material for this embodiment of the invention is Thermoplastic Urethane, manufactured by K. J. Quinn and Co., Inc. This material has a durometer on the order of Shore A 80±3. The bezel defines an enclosure 113 shaped to conform to a crystal to be described below. A central opening 114 defines an overlapping ledge 115. A pair of oppositely disposed recesses 116 serve to retain the bell-shaped crystal as will be described.

The main body of the strap, on both the buckle and tongue sides is made up of alternating thickened portions 117 simulating "links" and deep grooves 118 acting as "hinges". The underside of the thickened portions is undercut as illustrated at 119 to lend some flexibility to the thickened portions. Under the grooves 118 are slight rounded sections 120. The buckle end 111 is thickened at its extremity 121 and provided with a hole 122 for the buckle shank. On the tongue end 112 of the strap, conventional buckle holes 123 are provided for the tang of the buckle. The juncture between bezel and strap portions on either side is defined by deep grooves 124 which result in a relatively thin bezel wall 125.

Figure 9:
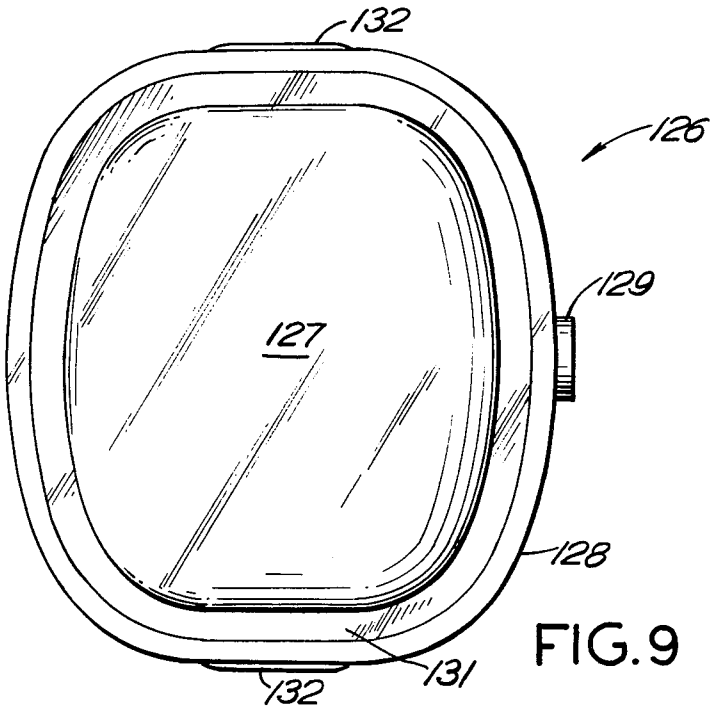
Figure 8:
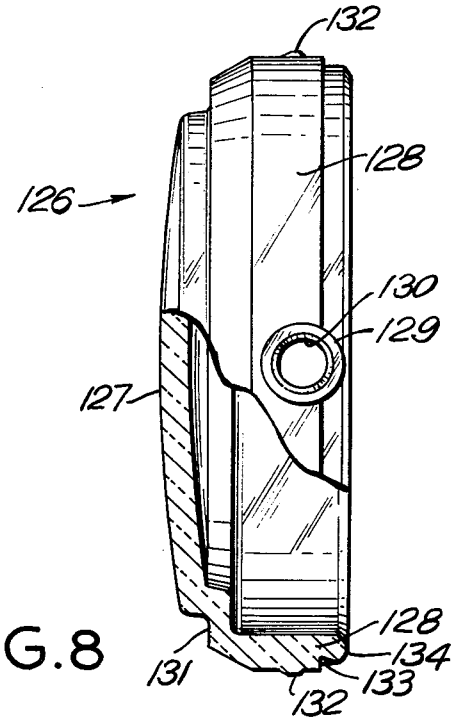

Referring now to FIGS. 8 and 9 of a drawing, a bell-shaped crystal adapted to cooperate with the integral bezel and strap is indicated generally at 126. The crystal is molded of transparent plastic material in a non-circular shape. In the embodiment shown, the shape is roughly eliptical but flattened at opposite ends of the major axis. Crystal 126 has a central viewing portion 127 and a depending wall portion 128, which incorporates an integral pendant 129 having a central opening 130. Depending wall portion 128 and central viewing portion 127 define between them a peripheral shoulder 131. Formed in diametrically opposite sides of depending wall 128 are protrusions 132 and recesses 133. Depending wall portion 128 terminates in a rounded peripheral rim 134.

Figure 11:
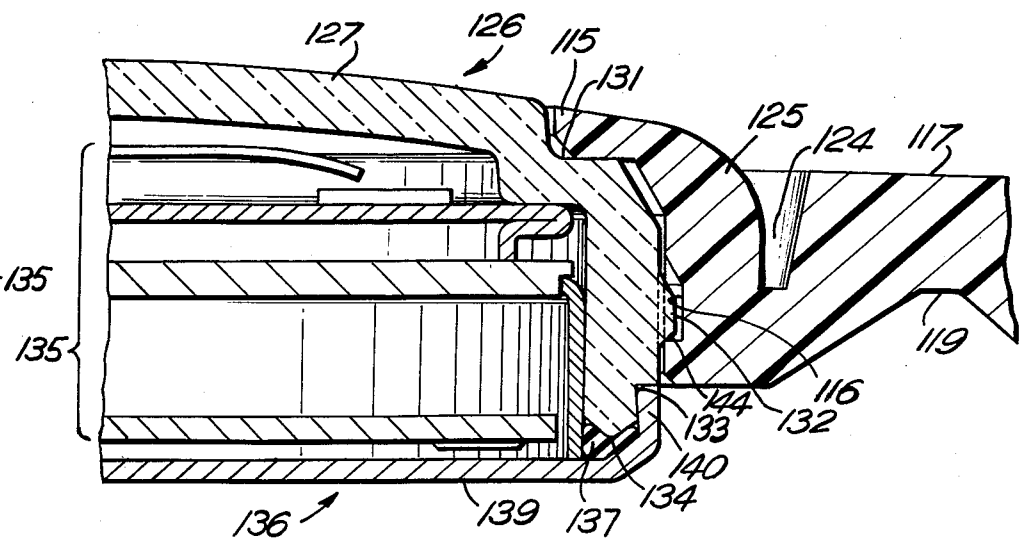
Figure 10:
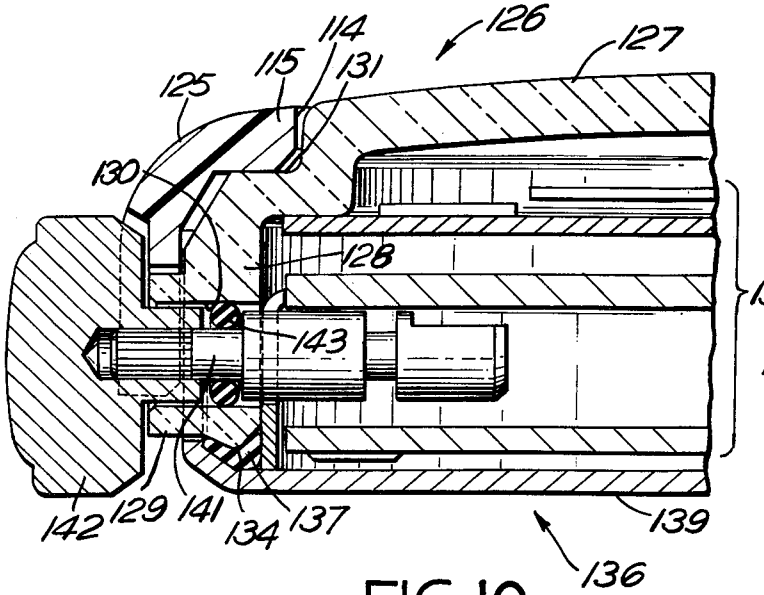

Referring now to FIGS. 10 and 11 of the drawing, the enlarged views indicate assembly of the wristwatch. FIG. 10, which is a cross section through the crown portion of the watch, shows a movement 135 disposed within a water-resistant enclosure made up of the crystal 126 and a caseback 136 with a gasket 137 of elastomeric material compressed therebetween. Caseback 136 may either be metal or plastic and is of a non-circular shape conforming generally to the rim 134 of the crystal depending wall 128. The caseback has a central portion 139 and a peripheral wall 140 overlapping the bottom of the crystal wall 128. Hole 130 in the integral pendant 129 receives a conventional stem 141 and crown 142 assembly with an "O" ring seal 143.

Although the movement 135 is illustrated for a mechanical analog watch with hands, and the crown, stem and seal 141, 142, 143 are illustrated for a conventional winding and setting mechanism, these aspects of the present invention are immaterial. Alternatively, movement 135 could be a solid state module or a stepping motor quartz analog movement of a type well known in the art and elements 141, 142, 143 would then comprise a sealed push button for actuating the electronic switching circuits in the wristwatch without departing from the present invention.

FIG. 11, which is a cross-section through the wristwatch at the juncture between strap and bezel, shows the protrusions 132 on the crystal wall fitting within recesses 116 in the bezel. The protrusions 132 include inclined walls 144 bearing on the bottom of recess 116 to force the crystal and its shoulder 131 toward the peripheral ledge 115 of the bezel, which rests on shoulder 131 of the crystal. Rigidity and support is imparted to the relatively thin plastic bezel wall 125 by the depending crystal wall 128.

OPERATION

The wristwatch of FIGS. 6–11 is assembled by inserting the movement into the bell-shaped crystal and applying caseback 136 with a snap-fit enabled by the caseback walls 140 and grooves 133. A water-resistant enclosure is therefore achieved by means of the compressed gasket 137. The watch crown within its pendant are part of the foregoing assembly.

The crystal and movement assembly are then inserted into the bezel enclosure 113, this being enabled by slightly bending the bezel, and retained by protrusions 132 on the crystal wall which are forced into the mating recesses 116 in the bezel wall.

Added strap flexibility is largely imparted by the deep grooves 118 acting as "hinges" about fulcrum points 120. Slight additional flexibility of the strap is provided by the undercut portions 119.

While there has been described herein what is considered to be the preferred embodiment of the invention, and modifications thereof, it is desired to secure in the appended claims all such modifications as fall within the true spirit and scope of the invention.

I claim:

1. In a wristwatch of the type having a bell-shaped crystal molded of transparent material with a central viewing portion and a depending peripheral wall portion terminating in a lower end, said wall portion having an integral pendant formed therein, and having a snap-fit caseback adapted to be separably attached to the lower end of said depending wall portion to form a water-resistant enclosure for the wrist-watch, the improvement comprising:

an integral strap and bezel molded of plastic material and having a bezel interposed between and joined to opposite strap portions, whereby the strap portions blend into and become an integral part of the bezel, said bezel having a peripheral wall surrounding said depending wall portion of said crystal, and having a peripheral ledge defining a central opening surrounding said crystal viewing portion, said bezel peripheral wall being arranged so as not to obstruct removal of the snap-fit caseback from the lower end of said crystal depending peripheral wall portion, and means comprising a plurality of integral protrusions extending on opposite diametral sides of the crystal away from the crystal depending wall portion, said protrusions cooperating with the bezel and adapted to retain the crystal within the bezel.

2. The improvement according to claim 1, wherein said crystal wall protrusions comprise a pair of diametrically opposed ears, and wherein portions of said bezel wall is molded around said protrusions to hold the crystal in the bezel.

3. The improvement according to claim 2, wherein said protrusions include openings therein, and wherein said bezel material substantially fills said openings.

4. The improvement according to claim 2, wherein said protrusions are curved downwardly away from the viewing portion of the crystal, and wherein the bezel and strap portions are joined by a thickened tapered section molded over said protrusions.

5. The combination according to claim 1, wherein said crystal defines a peripheral shoulder around the central viewing portion, said shoulder being covered by said bezel peripheral ledge, and wherein said bezel peripheral wall includes a plurality of diametrically opposed recesses adapted to receive said protrusions on the crystal wall and cooperating to hold the crystal in the bezel.

6. The combination according to claim 5, wherein said protrusions include inclined walls bearing on the bottom of said recesses to force the crystal shoulder against the bezel ledge.

7. In a wristwatch of the type having a bell-shaped crystal molded of transparent plastic material with a central viewing portion and a depending wall portion with an integral pendant formed therein, and having a caseback adapted to be attached to the rim of said depending wall portion with a compressible gasket in a snap-fit to provide a water-resistant enclosure for the wristwatch, the improvement comprising:

an integral strap and bezel molded of plastic material and having a bezel interposed between and joined to opposite flexible strap portions, whereby the strap portions blend into and become an integral part of the bezel, said crystal wall including at least one pair of diametrically opposed protrusions spaced from said rim, said bezel having a peripheral wall surrounding said depending wall portion of the crystal and having a peripheral ledge defining a central opening surrounding the crystal viewing portion, said bezel peripheral wall being formed with diametrically opposed cavities adapted to receive said protrusions with a snap-fit and cooperate with the protrusions to retain the crystal in the bezel without obstructing the removal of said caseback.

* * * * *